US008857510B2

(12) United States Patent
Rasmus et al.

(10) Patent No.: US 8,857,510 B2
(45) Date of Patent: Oct. 14, 2014

(54) SYSTEM AND METHOD FOR DETERMINING MOVEMENT OF A DRILLING COMPONENT IN A WELLBORE

(75) Inventors: John Rasmus, Richmond, TX (US); John James, Houston, TX (US); William Lesso, Anderson, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 783 days.

(21) Appl. No.: 12/754,235

(22) Filed: Apr. 5, 2010

(65) Prior Publication Data

US 2010/0282512 A1 Nov. 11, 2010

Related U.S. Application Data

(60) Provisional application No. 61/166,581, filed on Apr. 3, 2009.

(51) Int. Cl.

| | |
|---|---|
| ***E21B 47/00*** | (2012.01) |
| ***E21B 47/024*** | (2006.01) |
| ***E21B 47/04*** | (2012.01) |
| ***E21B 47/09*** | (2012.01) |

(52) U.S. Cl.

CPC ..... *E21B 47/024* (2013.01); *E21B 47/04* (2013.01); *E21B 47/09* (2013.01)

USPC ..... 166/255.1; 175/45

(58) Field of Classification Search

USPC ..... 175/50, 45; 166/255.1; 73/152.03, 73/152.44

See application file for complete search history.

(56) References Cited

U.S. PATENT DOCUMENTS

| | | | |
|---|---|---|---|
| 3,807,502 | A | 4/1974 | Heilhecker et al. |
| 3,957,118 | A | 5/1976 | Barry et al. |
| 4,126,848 | A | 11/1978 | Denison |
| 4,605,268 | A | 8/1986 | Meador |
| 4,806,928 | A | 2/1989 | Veneruso |
| 4,901,069 | A | 2/1990 | Veneruso |
| 5,052,941 | A | 10/1991 | Hernandez-Marti et al. |
| 5,278,550 | A | 1/1994 | Rhein-Knudsen et al. |
| 5,531,592 | A | 7/1996 | Tasi |

(Continued)

FOREIGN PATENT DOCUMENTS

| | | |
|---|---|---|
| RU | 2040691 | 7/1995 |
| RU | 2140527 | 10/1999 |
| WO | WO9014497 | 11/1990 |
| WO | WO2004085796 | 10/2004 |

*Primary Examiner* — Shane Bomar
*Assistant Examiner* — Kipp Wallace
(74) *Attorney, Agent, or Firm* — Kimberly Ballew; Mark D. Shelley II

(57) ABSTRACT

A system and a method determine movement of a drilling component, such as, for example, a tool, a drill bit or other wellbore device, within a wellbore. The system and method may process information obtained from the wellbore by using, for example, a numerical processing algorithm. The information may be data acquired during drilling of the wellbore. Rig surface data recording systems may track the position of the drill bit, the BHA and/or other component of the drill string during the time the component is within the wellbore. Downhole measuring devices may record data at various positions along the BHA and above the drill bit as a function of time.

16 Claims, 7 Drawing Sheets

(56) References Cited

U.S. PATENT DOCUMENTS

| | | | | |
|---|---|---|---|---|
| 5,624,051 | A | 4/1997 | Ahern, Jr. et al. | |
| 5,971,072 | A | 10/1999 | Huber et al. | |
| 6,641,434 | B2 | 11/2003 | Boyle et al. | |
| 6,708,781 | B2 * | 3/2004 | Ireland | 175/40 |
| 6,866,306 | B2 | 3/2005 | Boyle et al. | |
| 7,413,021 | B2 | 8/2008 | Madhavan et al. | |
| 2003/0042020 | A1 * | 3/2003 | Newman | 166/250.15 |
| 2004/0138818 | A1 * | 7/2004 | Shray et al. | 702/6 |
| 2005/0087367 | A1 * | 4/2005 | Hutchinson | 175/45 |
| 2006/0239118 | A1 * | 10/2006 | Guidry et al. | 367/68 |
| 2008/0164062 | A1 * | 7/2008 | Brackin et al. | 175/24 |
| 2009/0166087 | A1 | 7/2009 | Braden et al. | |

* cited by examiner

SYSTEM AND METHOD FOR DETERMINING MOVEMENT OF A DRILLING COMPONENT IN A WELLBORE

This application claims the benefit of U.S. Provisional Application Ser. No. 61/166,581, entitled "System and Method for Determining Movement of a Drilling Component in a Wellbore," filed Apr. 3, 2009, which is hereby incorporated by reference in its entirety.

BACKGROUND OF THE INVENTION

The present invention generally relates to a system and a method for determining movement of a drilling component, such as, for example, a tool, a drill bit or other wellbore device, within a wellbore.

To obtain hydrocarbons, a drilling tool is driven into the ground surface to create a borehole through which the hydrocarbons are extracted. Typically, a drill string is suspended within the borehole. The drill string has a drill bit at a lower end of sections of drill pipe. The drill string extends from the surface to the drill bit. The drill string has a bottom hole assembly ("BHA") located proximate to the drill bit, which consists of one or more tools, such as measuring devices, power supplies, motors, stabilizers or the like.

Wellbores are drilled to locate and produce hydrocarbons. A downhole drilling tool with a drill bit at one end thereof is advanced into the ground via a drill string to form a wellbore. The drill string and the downhole tool are typically made of a series of drill pipes connected together by threads to form a long tube with the drill bit at the lower end thereof. As the drilling tool is advanced, a drilling fluid, such as mud, is pumped from a surface pit, through the drill string and the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to provide communication between the surface and the downhole tool. Wellbore telemetry devices are typically used to allow, for example, command and/or communication signals to pass between a surface unit and the downhole tool. These signals are used to control the operation of the downhole tool and send downhole information to the surface.

Various wellbore telemetry systems may be used to establish the desired communication capabilities. Examples of such systems may include a wired drill pipe wellbore telemetry system as described in U.S. Pat. No. 6,641,434, an electromagnetic wellbore telemetry system as described in U.S. Pat. No. 5,624,051, an acoustic wellbore telemetry system as described in PCT Patent Application No. WO2004085796, the entire contents of which are hereby incorporated by reference. Other data conveyance or communication devices, such as transceivers coupled to sensors, may also be used to transmit power and/or data.

With wired drill pipe telemetry systems ("wired drill pipe"), the drill pipes that form the drill string are provided with electronics capable of passing a signal between a surface unit and the downhole tool. As shown, for example, in U.S. Pat. No. 6,641,434, such wired drill pipe telemetry systems can be provided with wires and inductive couplings that form a communication chain that extends through the drill string. The wired drill pipe is then operatively connected to the downhole tool and a surface unit for communication therewith. The wired drill pipe system is adapted to pass data received from components in the downhole tool to the surface unit and commands generated by the surface unit to the downhole tool. Further documents relating to wired drill pipes and/or inductive couplers in a drill string are as follows: U.S. Pat. Nos. 4,126,848, 3,957,118 and 3,807,502, the publication "Four Different Systems Used for MWD," W. J. McDonald, The Oil and Gas Journal, pages 115-124, Apr. 3, 1978, U.S. Pat. No. 4,605,268, Russian Federation Published Patent Application 2140527, filed Dec. 18, 1997, Russian Federation Published Patent Application 2,040,691, filed Feb. 14, 1992, WO Publication 90/14497A2, U.S. Pat. Nos. 5,052,941, 4,806,928, 4,901,069, 5,531,592, 5,278,550, and 5,971,072.

Frequently, during drilling of a wellbore, the BHA may move down a given distance and then be withdrawn from the wellbore for any number of reasons. For example, it may be necessary or beneficial to position a wireline and logging device into the wellbore to analyze the wellbore prior to continuing to drill. In another example, it may be necessary or beneficial to replace the drill bit, a component of the BHA, or a portion of the drill string. Also, the drill string may be stuck or it may be necessary to perform casing or other wellbore operations without the BHA within the wellbore.

Accordingly, it is common for the BHA, the drill bit, and other portions of the drill string to move past the same position within the wellbore numerous times prior to completing the drilling operations of the wellbore. As a result, the wellbore may become unstable or susceptible to damage based on the repeated movement of the drill bit, BHA or other component of the drill string past a position of the wellbore. Therefore, there is a need to monitor and record the frequency in which the drill bit, the BHA or other component passes a predetermined depth of the wellbore so that an operator may identify potential drilling hazards and take corrective action, if necessary.

DETAILED DESCRIPTION OF THE PRESENTLY PREFERRED EMBODIMENTS

Figure 1:
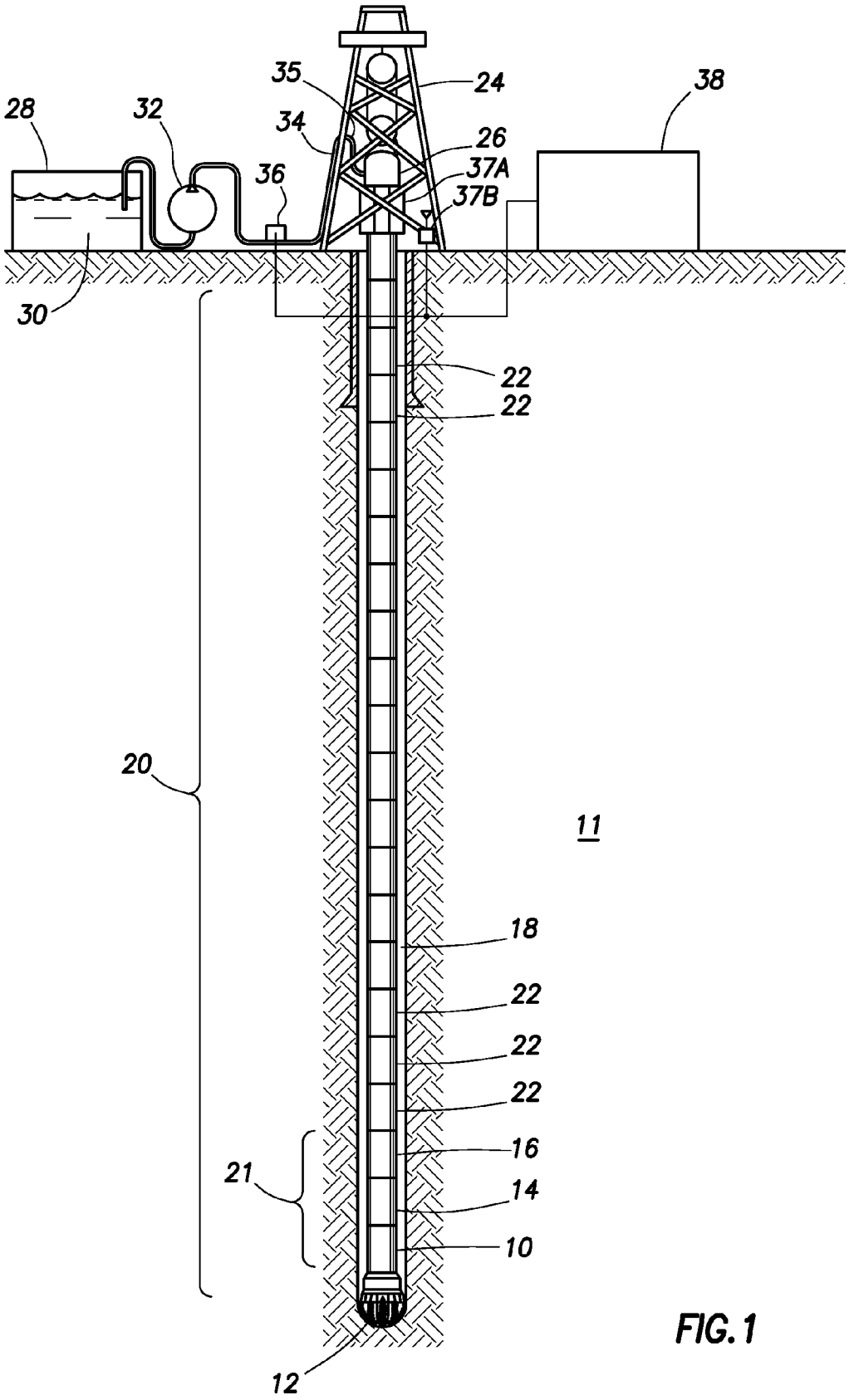
FIG. 1 illustrates a system for determining movement of a drilling component in an embodiment of the present invention.

The present invention generally relates to a system and a method for determining movement of a drilling component, such as, for example, a tool, a drill bit or other wellbore device, within a wellbore. More specifically, the system and method may process information obtained from the wellbore by using, for example, a numerical processing algorithm. The information may be data acquired during drilling of the wellbore. Rig surface data recording systems may track the position of the drill bit, the BHA and/or other component of the drill string during the time the component is within the wellbore. Downhole measuring devices may record data at various positions along the BHA and above the drill bit as a function of time.

In an embodiment, a bit transit counter (hereinafter "BTC") generates a data matrix of the wellbore where the index is depth and, for each depth increment, the time that the drill bit, the BHA or other component passes the depth increment may be added to the matrix. Accordingly, the matrix may provide a frequency in which the drill bit, the BHA or other drilling component passes a specific depth over a predetermined time, either since initiation of drilling or over a predetermined time.

The depth or position of interest in the wellbore may be the depth of a predetermined sensor or multiple sensors or other downhole devices. In an embodiment, the depth may be the depth of a density sensor. Of course, the system and method may record or otherwise measure the frequency in which the drill bit, the BHA or other component passes multiple locations in the wellbore. The depth of the sensor at a specific time may be determined based on the depth of the drill bit at the specific time and the distance between the drill bit and the sensor along the BHA. The BTC data may be represented as a function of time and may be stored, displayed and manipulated in a database with the other sensor measurements in the BHA. Advantageously, this permits the pairing of the BTC data with the measured sensor data including but not limited to a petrophysical image measured as a function of time. The normal and current time-to-depth gating process in the acquisition systems may be used to translate the data to a depth index resulting in a wellbore image log alongside the BTC curve, which may detail a number of drill bit transits that had occurred when the image was recorded.

In an embodiment, the BTC may consist of a two stage data analysis process. The first stage reviews the drill bit depth data to eliminate small changes in the drill bit travel direction. For example, a predetermined distance of travel may be set in which the BTC will not count the pass of the drill bit, the BHA or other component past the position in the wellbore. Specifically, the drill bit may move down and then may be raised up momentarily, or there may be fluctuations in direction due to data recording characteristics. Such events may result in unreasonably large drill bit transit counts. Accordingly, if the predetermined distance is ten feet, drilling movement may occur that moves the drill bit from a first position to a second position that is nine foot closer to the surface than the first position, and the BTC may be set to disregard the passage of the first position at that time based on the predetermined distance of ten feet. Of course, the predetermined distance may be any distance and is not limited to ten feet, which is merely used as an example. The system and method permit the selection of any distance.

The second stage of the analysis may establish the BTC matrix with the increasing wellbore depth as the index in increments, such as 0.5 feet or 0.1 feet. In a preferred embodiment, the matrix may be used to analyze the drill bit depth data for an open hole section of a wellbore; however, the system and method may be applied to cased sections of a wellbore. The depth of interest may be selected. In an embodiment, the depth of interest is established by noting, as an input parameter, a sensor offset distance. Two depths, for example, may be used in this computation, such as, for example, a drill bit (or BHA or component) depth from a measurement and a sensor depth, which may be a computation based on drill bit depth.

Referring now to the drawings wherein like numerals refer to like parts, FIG. 1 illustrates a drilling rig 24 which may suspend a drill string 20 within a wellbore 18 being drilled through subsurface earth formations 11. The drill string 20 may be assembled by coupling together end-to-end segments ("joints") 22 of drill pipe. For example, the joints 22 may have threads that enable connection to each other. The drill string 20 may have a drill bit 12 at the lower end of the drill string 20. A bottom hole assembly 21 (hereafter "the BHA 21") that may be located adjacent to the drill bit 15. If the drill bit 12 is urged into the formations 11 at the bottom of the wellbore 18 and/or rotated by equipment, such as, for example, a top drive 26 located on the drilling rig 24, the drill bit 12 may extend the wellbore 18. The top drive 26 may be substituted in other embodiments by a swivel, a kelly, a kelly bushing, a rotary table and/or the like. Accordingly, the present invention is not limited to use with top drive drilling systems.

The lower end of the drill string 20 may have, at a selected position above and proximate to the drill bit 12, a hydraulically operated motor ("mud motor") 10 to rotate the drill bit 12 either by itself or in combination with rotation of the drill string 20 from the surface. The BHA 21 and/or the lower end of the drill string 20 may have one or more MWD instruments 14 and/or one or more LWD instruments 16 as well known in the art.

During drilling of the wellbore 18, a pump 32 may lift drilling fluid 30 from a drilling fluid tank 28. The pump 32 may direct the drilling fluid 30 under pressure through a standpipe 34, a flexible hose 35 and/or the top drive 26 and into an interior passage (not shown separately in FIG. 1) inside the drill string 20. The drilling fluid 30 may exit the drill string 20 through nozzles (not shown separately) in the drill bit 12, thereby cooling and lubricating the drill bit 12 and lifting drill cuttings generated by the drill bit 12 to the Earth's surface.

The MWD instrument 14 or LWD instrument 16 may be associated with a telemetry transmitter (not shown separately) that modulates flow of the mud 30 through the drill string 20. Modulation of the flow of the mud 30 may cause pressure variations in the mud 30 that may be detected at the Earth's surface by a pressure transducer 36 which may be located between the pump 32 and the top drive 26. Signals from the transducer 36 which may be, for example, electrical signals and/or optical signals, may be conducted to a recording unit 38 for decoding and interpretation using techniques known in the art. The decoded signals may correspond to measurements made by one or more of the sensors (not shown) in the MWD instrument 14 and/or the LWD 16 instrument. Such mud pressure modulation telemetry may be used in conjunction with, or as backup for another type of telemetry system, such as acoustic telemetry, electromagnetic telemetry, and/or wired drill pipe as described hereafter.

A wireless transceiver 37A may be disposed in the uppermost part of the drill string 20 and may be directly coupled to the top drive 26. The wireless transceiver 37A may have communication devices to wirelessly transmit data between the drill string 20 and a terminal 38. For example, a second wireless transceiver 37B may transmit the data between the drill string 20 and a terminal 38.

An electromagnetic transmitter (not shown separately) may be included in the LWD instrument 16 and may generate signals that are communicated along electrical conductors in wired drill pipe. For example, the joints 22 may be wired drill pipe joints which may be interconnected to form the drill string 20. The wired drill pipe may provide a signal communication conduit communicatively coupled at each end of each of the wired drill pipe joints. For example, the wired drill pipe preferably has an electrical and/or optical conductor extending at least partially within the drill pipe with inductive couplers positioned at the ends of each of the wired drill pipe joints. The wired drill pipe enables communication of the data from downhole to the terminal 38. Examples of wired drill pipe that may be used in the present invention are described in detail in U.S. Pat. Nos. 6,641,434 and 6,866,306 to Boyle et al. and 7,413,021 to Madhavan et al. and U.S. Patent App. Pub. No. 2009/0166087to Braden et al., assigned to the assignee of the present application and incorporated by reference in their entireties. The present invention is not limited to a specific embodiment of the wired drill pipe and/or the wired drill pipe joints. The wired drill pipe may be any telemetry system capable of transmitting the data from downhole to the terminal 38 and transmitting the control signals downhole from the terminal 38 as known to one having ordinary skill in the art.

The terminal 38 may be located at the surface adjacent to the drilling rig 24; alternatively, the terminal 38 may be located remotely, and the data may be transmitted between the drilling site to the terminal 38. In an embodiment, the terminal 38 may be downhole such that the terminal 38 may be located in the wellbore 18 and/or may be mechanically connected to the drill string 20. The terminal 38 may be any device or component for receiving, analyzing and/or manipulating the data. The terminal 38 preferably has a processor for processing the data. The terminal 38 may receive the data and/or may transmit control signals downhole using mud pulse telemetry and/or wired drill pipe as discussed previously. The present invention is not limited to a specific embodiment of the terminal 38, and the drilling system 10 may have any number of terminals.

Figure 2:
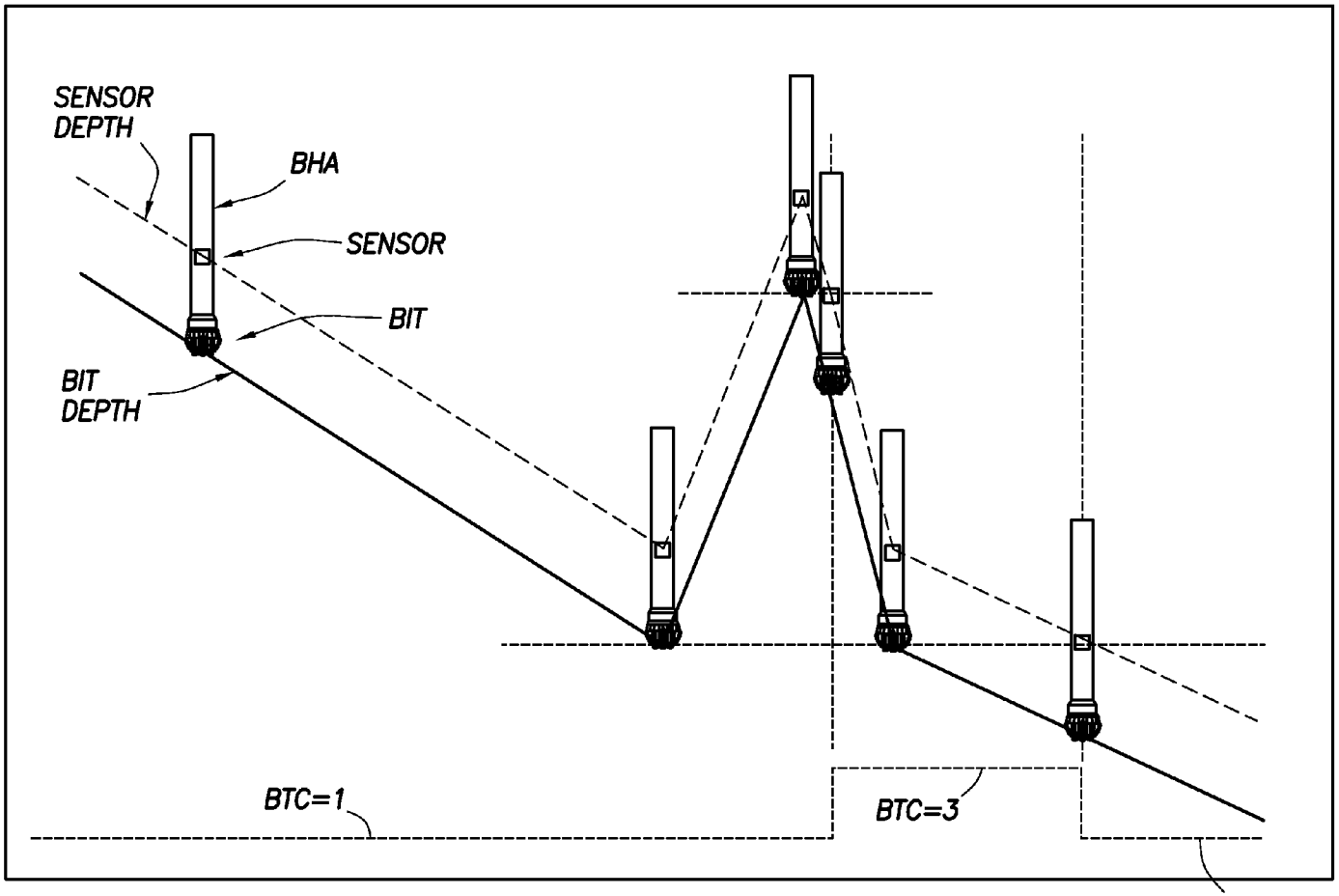
FIG. 2 illustrates an example of a drill bit transit counter logic in an embodiment of the present invention.

FIG. 2 illustrates an embodiment of the BTC counter logic and concept which may be performed by the terminal 38. The following description related to FIG. 2 is merely one example of the system and method of the invention and should not be deemed as limiting the invention. When the drill bit 12 (or the BHA 21, or other component) exits the casing shoe, in this example, for the first time, usually a drilling process, each hole depth index interval counter is advanced. When the sensor exits the casing some time later, the terminal 38 may determine that the BTC value reads the contents of the corresponding hole depth index interval (in this case, a one) and/or may record the BTC value as a function of time. The terminal will maintain the BTC value as one as long as drilling down continues. When the drill bit 12 is pulled or otherwise moved off bottom, the terminal 38 may maintain the BTC value as one. When the drill bit 12 is lowered back to the bottom, such as when a connection is made, the terminal 38 may maintain the BTC value as one. When the sensor reaches the uppermost depth the drill bit 12 reached when the drill bit 12 was pulled back, the terminal 38 may increase the BTC value to three as the terminal 38 determines the original drilling transit, the ream-up transit and the ream-down transit. The BTC value in this example uses odd numbers; however, other numbers may be used.

The terminal 38 may determine multiple BTC values simultaneously for various sensors and/or various depths. These BTC values may also be conditioned against other well and drilling parameters. A transit, for example, may be disregarded by the terminal 38 if circulation is being performed while moving the drill pipe, the drill bit 12 or other component has not traverse more than a certain number of feet, or the drill string 20 is being rotated while drilling, or the like. The terminal 38 may increment and/or may multiply the BTC value by a factor under predetermined conditions, such as, for example, reaming faster than a given threshold, rotating or not rotating, the clearance between the drill bit 12 and the wall of the wellbore, the number of stabilizers and their placement in the BHA 21 and the like.

Figure 3:
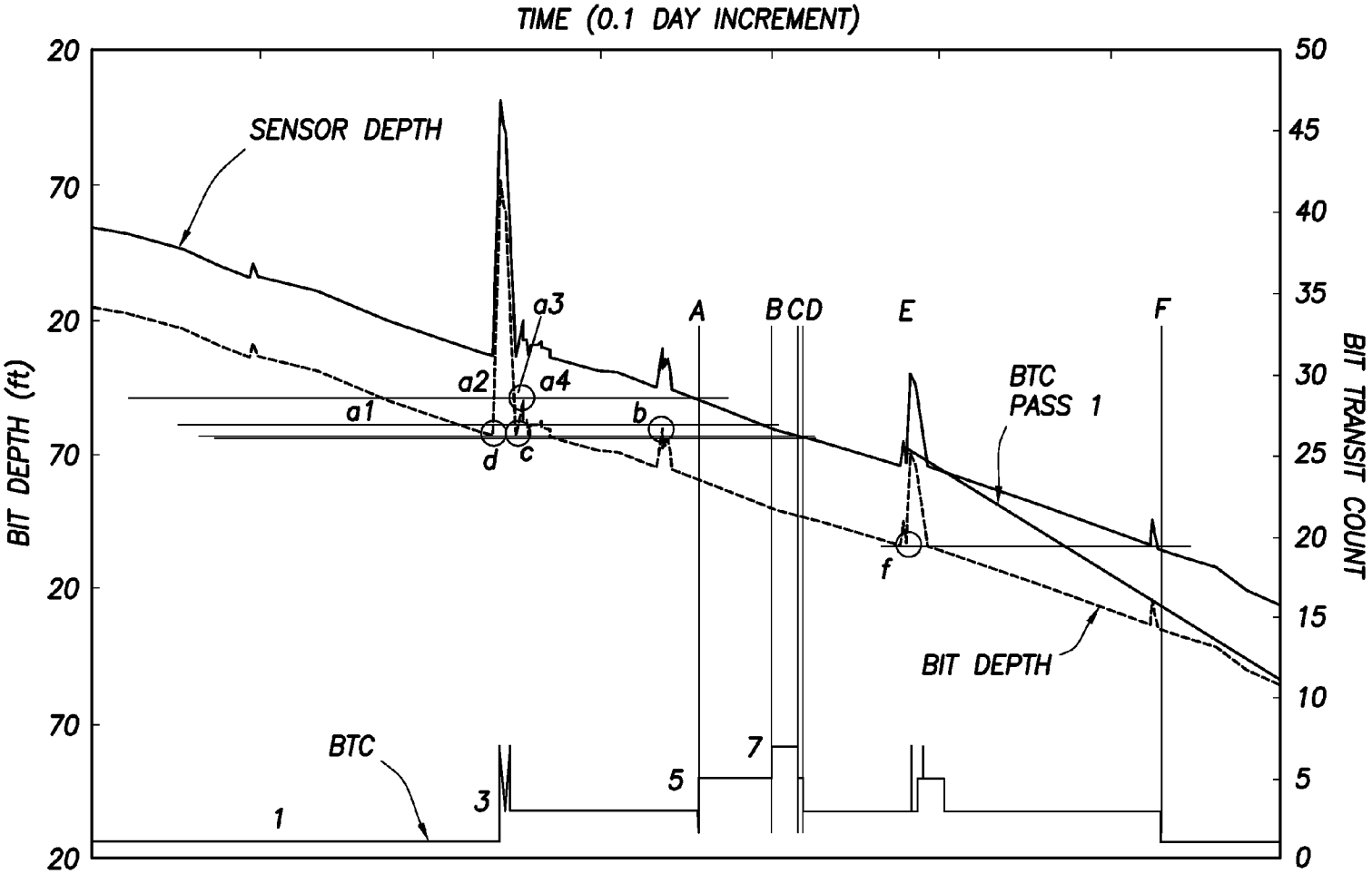
FIG. 3 illustrates an example of a time/depth plot in an embodiment of the present invention.

FIG. 3 illustrates an example of a time/depth plot of the drilling of parts of two stands of drill pipe. The terminal 38 may generate the time/depth plot. The X axis is time and spans 0.7 days (17 hours) in this example. The Y axis is depth covering three hundred feet in this example. One of the curves illustrates drill bit depth over time interval while along curve is a sensor depth, approximately thirty feet above the drill bit 12. Yet another curve is the drill bit transit depth showing the valid transits. Lastly, another curve shows the drill bit transits at a given time and sensor depth. The terminal 38 may determine drill bit transit values by counting the number of times the drill bit transit curve crosses a horizontal line from a particular sensor depth and time. At time "A", for example, the terminal 38 may increase the BTC value from three to five. Before time "A", the BTC counter at sensor depth notes that the drill bit 12 passed when the hole was drilled "a1". The drill bit 12 passed again when reamed-up before the connection "a2" and then reamed down "a3". Therefore, there are three drill bit transits in this example. At time "A", the sensor encounters the top of the short ream at point "a4" and the BTC value moves from three to five. At time "B", the sensor encounters the subsequent short ream at point "b" and still has the previous five transits. The terminal may increase the BTC value to seven. At time "C", the sensor drops below the lowest depth of the short ream after the connection at point "c" and the terminal 38 may decrease the BTC value to five. Shortly after that, time "D", the sensor depth falls below the lowest point of the pre-connection ream at point "d" and the terminal 38 may decrease the BTC value to three. A short ream occurs at time "E" that briefly raises the BTC counter to five before remaining at three. Then, at point "F", the sensor falls below that short ream and is below all the other reams. The terminal 38 may decrease the BTC value.

Figure 4:
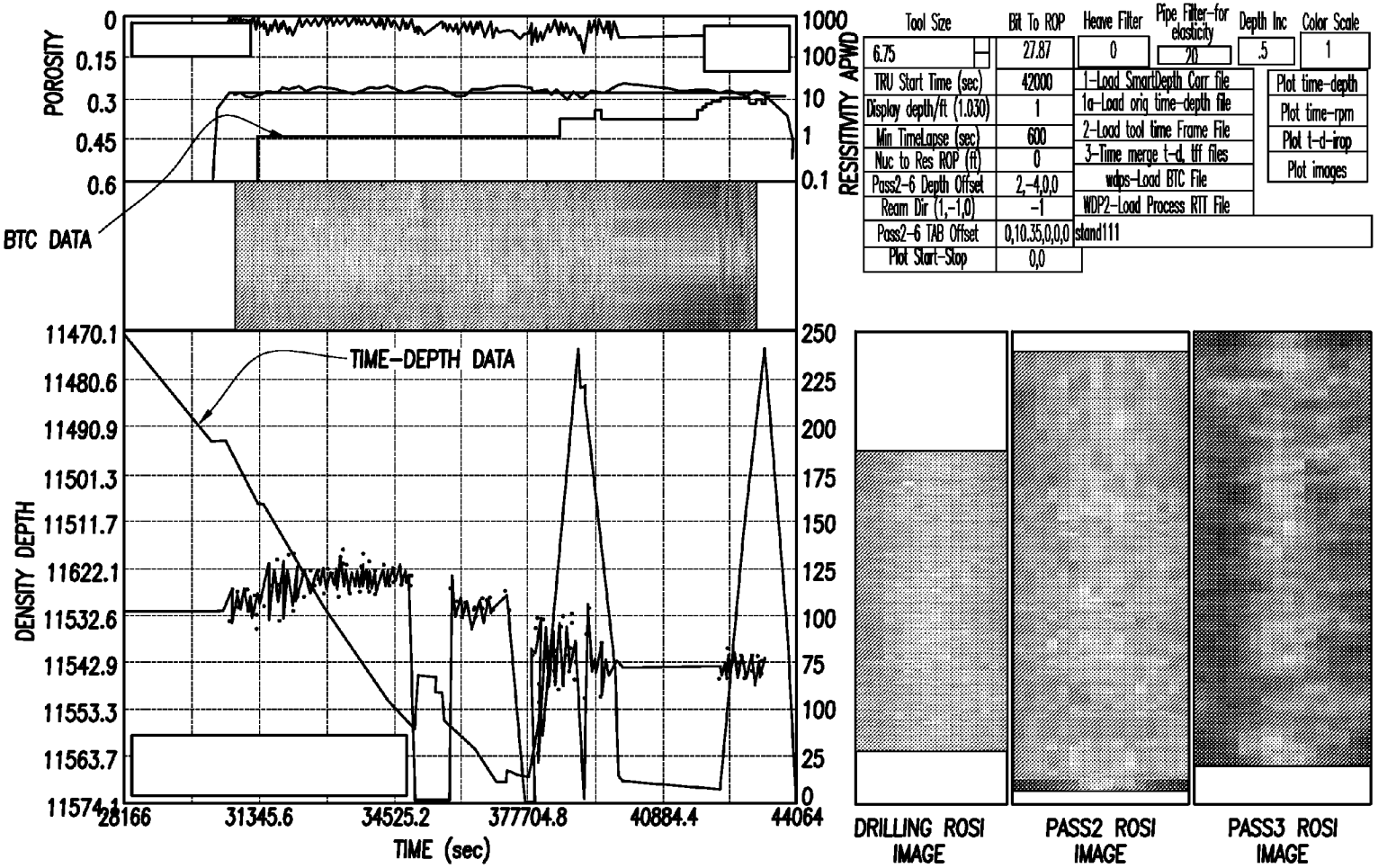
FIG. 4 illustrates a drill bit transit counter and sensor measurements transformed to a depth based measurement in an embodiment of the present invention.
Figure 5:
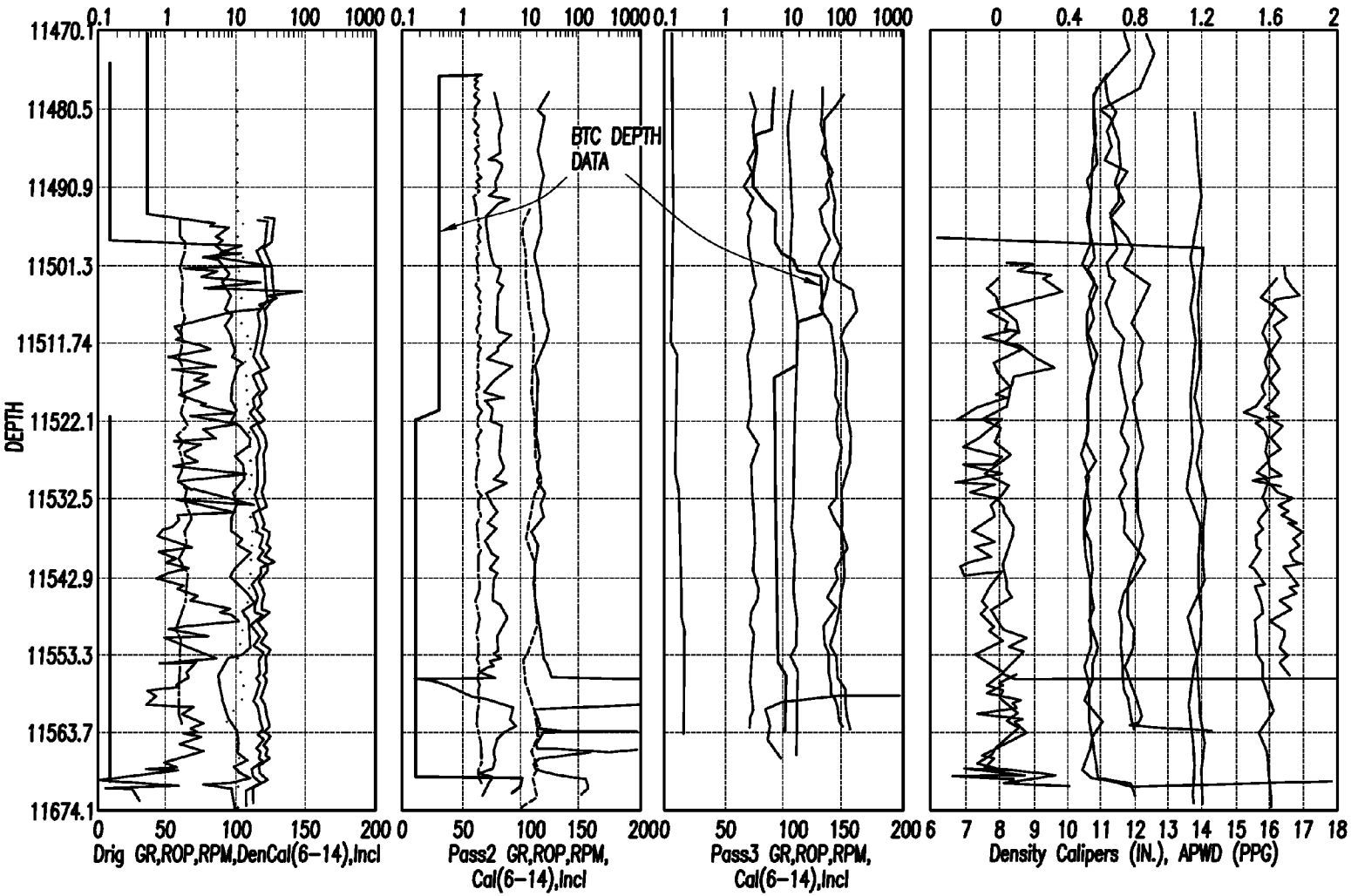
FIG. 5 illustrates a time-based drill bit transit counter and sensor data transformed to a depth index in an embodiment of the present invention.

The petrophysical measurements made at the sensor depth may be transformed from a time index to a depth index by the terminal 38. Since the BTC value is in the same index, time, the BTC value may be transformed to a depth index and then used in evaluating the condition of the wellbore wall along with the petrophysical image and log data. FIGS. 4 and 5 illustrate an application executed by the terminal 38 that captures, stores, displays and manipulates the time based the BTC values and sensor data and then transforms them to depth based measurements. The sensor data may be transmitted to the terminal 38 using mud pulse telemetry and/or the wired drill pipe. More specifically, FIG. 4 illustrates drill bit transit counter and sensor measurements transformed by the terminal 38 to a depth based measurement in an embodiment of the present invention.

FIG. 5 illustrates the time-based BTC values and sensor data transformed to a depth index by the terminal 38 in an embodiment of the present invention. The first panel is the while-drilling data with a BTC value of one, as expected. The second panel represents the ream up data obtained immediately, for example, after drilling. The lower portion is one, as expected, and increases to three at the top due to an earlier short trip over that interval. The third panel is the sensor data recorded, measured, or stored from a ream up pass performed 10.35 days after drilling. The BTC values are higher due to the additional passes over the interval.

Figure 6:
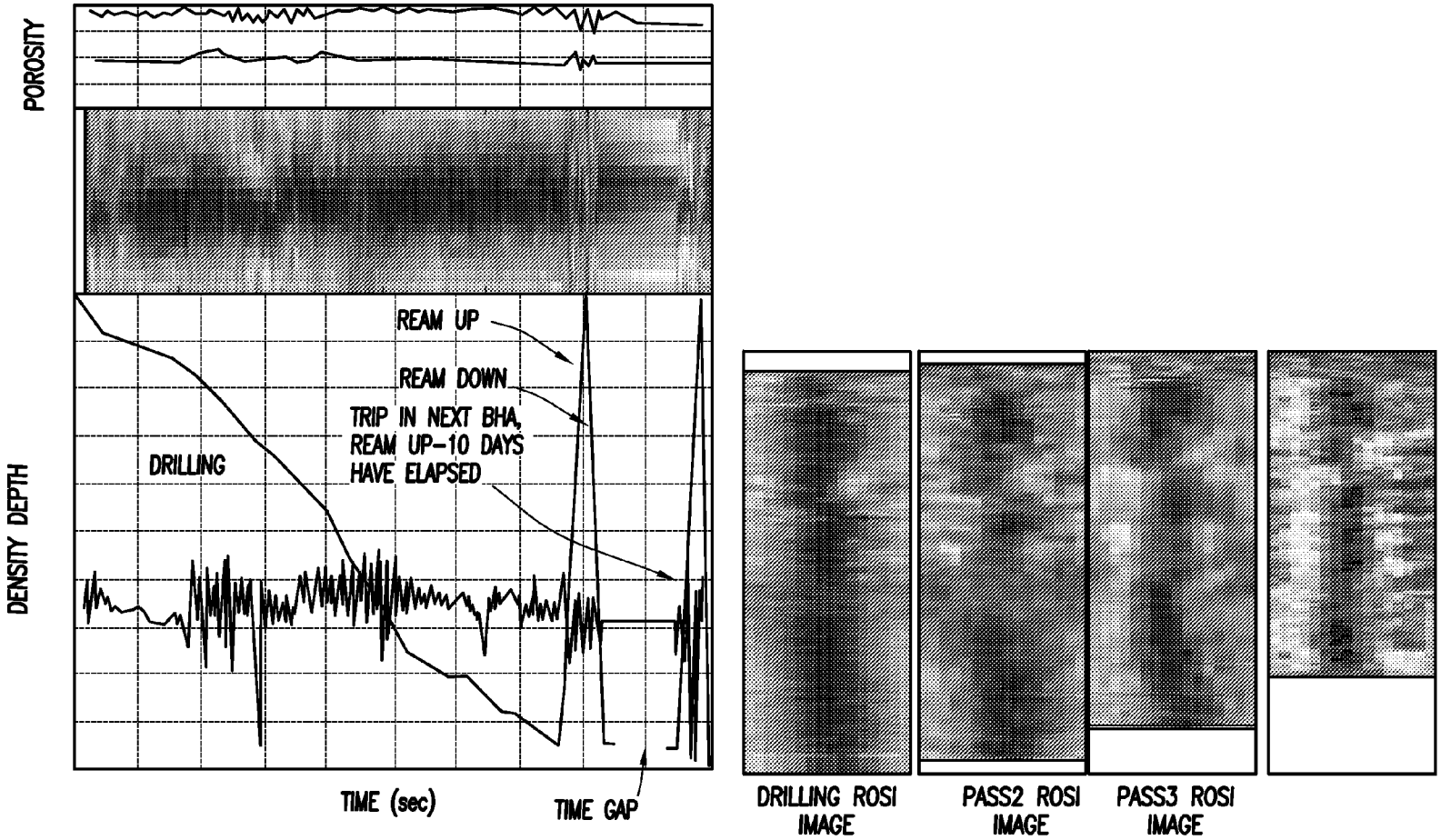
FIG. 6 illustrates drill bit passes on a depth and time graph in an embodiment of the present invention.

FIG. 6 illustrates drill bit passes on a depth and time graph in an embodiment of the present invention. The terminal 38 may generate the depth and time graph which depicts the drill bit passes.

Figure 7:
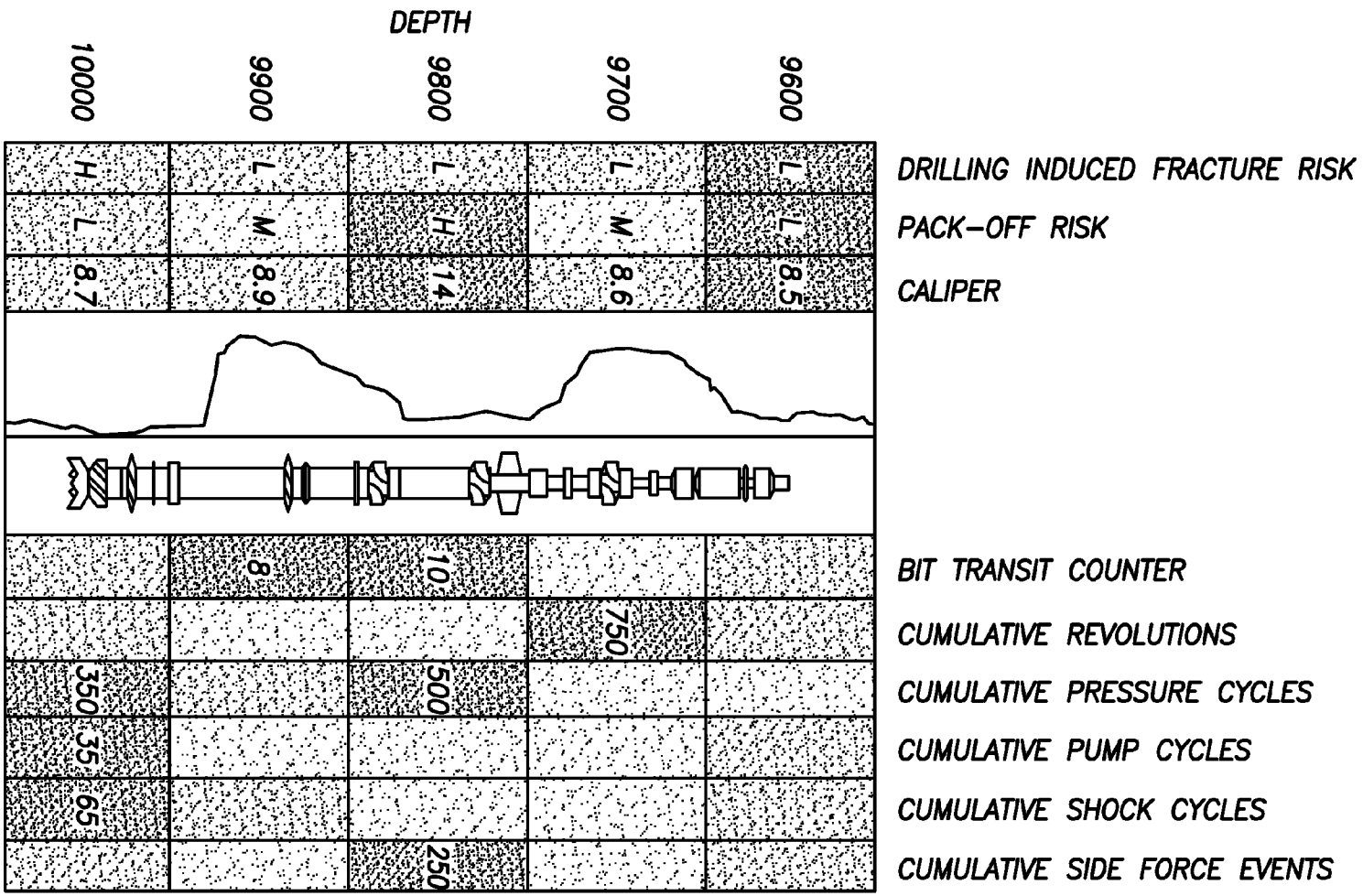
FIG. 7 illustrates a display which indicates wellbore stability at various depths in an embodiment of the present invention.

FIG. 7 illustrates a display of cumulative measurements, described in more detail hereafter, as a function of depth of the drill bit 16 as may be displayed by the terminal 38. The cumulative measurements may be transmitted from downhole to the terminal 38 using mud pulse telemetry and/or the wired drill pipe. For example, the terminal 38 may use "traffic light signals" such that a red box indicates that the depth corresponding to the red box may have wellbore damage, compromised wellbore stability, a stuck pipe event, a wellbore pack-off, formation of a tight hole and/or the like. For example, the display may indicate a drilling-induced fracture risk and/or a pack-off risk. In such an embodiment, a green box may indicate that the wellbore 18 may be stable at the depth corresponding to the green box. For example, a red box may indicate high risk, a green box may indicate low risk, and/or a yellow box may indicate moderate risk at a specific depth of the drill bit 16. FIG. 7 is an example of a display of the cumulative measurements as a function of depth of the drill bit 16, and the present invention is not limited to the specific embodiment depicted in FIG. 7.

In an embodiment, the terminal 38 may determine and/or may indicate the number of revolutions the drill bit 16 performed at various depths. For example, the sensor data transmitted from downhole to the terminal 38 by mud pulse telemetry and/or the wired drill pipe may be used to determine the number of revolutions the drill bit 16 performed at various depths. The number of revolutions the drill bit 16 performed may be a function of the RPM and ROP during drilling and/or the revolutions during any reaming operations. Borehole mechanical damage may be correlated to the number of revolutions the drill bit 16 performed.

In an embodiment, the terminal may determine and/or may indicate the number of lateral shocks to which the formation 11 was subjected at the time and depth that the sensor is currently generating a measurement. For example, the sensor data transmitted from downhole to the terminal 38 by mud pulse telemetry and/or the wired drill pipe may be used to determine the number of lateral shocks to which the formation 11 was subjected. Shock levels and/or shock risk for one or more tools may be input into the terminal 38. Fatigue associated with repeated lateral shocks may be attributed to the creation of wellbore breakouts, BHA failure, and MWD/LWD tool failure.

In an embodiment, the terminal may determine and/or may indicate the number of delta pressure per second to which the formation has been subjected at the time and depth that the sensor is currently generating a measurement. For example, the sensor data transmitted from downhole to the terminal 38 by mud pulse telemetry and/or the wired drill pipe may be used to determine the number of delta pressure per second to which the formation has been subjected. Fatigue associated with repeated pressure cycles may be attributed to the creation of wellbore breakouts. The number of delta pressure per second to which the formation has been subjected may include the minimum, the maximum and the average cumulative delta pressure imposed on the formation.

In an embodiment, the terminal may determine and/or may indicate the number of times the pumps were cycled. For example, the sensor data transmitted from downhole to the terminal 38 by mud pulse telemetry and/or the wired drill pipe may be used to determine the number of times the pumps were cycled. Pump cycles may create surge events and associated fatigue associated with drilling-induced fractures.

In an embodiment, the terminal may determine and/or may indicate the total side forces applied to the borehole wall at the time and depth that the sensor is generating a measurement. For example, the sensor data transmitted from downhole to the terminal 38 by mud pulse telemetry and/or the wired drill pipe may be used to determine the total side forces applied to the borehole wall. Larger values of the total side forces applied to the borehole wall may be associated with borehole wall fatigue, drop tendencies of the BHA 21, creation of high dog-legs and other heretofore unknown attributes.

In an embodiment, the terminal 38 may determine and/or may display an amount of time which lapsed since an event occurred at a predetermined depth, such as, for example, the drilling component moving past the predetermined depth. The terminal may use the sensor data transmitted from downhole to the terminal 38 by mud pulse telemetry and/or the wired drill pipe to determine the amount of time which lapsed since an event occurred at a predetermined depth. For example, the terminal 38 may determine the amount of time which lapsed since the drill bit 16 moved past each of a plurality of depths. Accordingly, the terminal 38 may display the time which lapsed since the drill bit 16 moved past a depth as a function of the depth. As another example, the terminal 38 may determine the amount of time which lapsed since each of a plurality of depths of the wellbore 18 experienced a lateral shock. Accordingly, the terminal 38 may display the time which lapsed since the a depth of the wellbore 18 experienced a lateral shock as a function of the depth.

The invention has been described and certain specific examples of the system and method have been illustrated and described. The invention should not be deemed as limited to these specific displays, measurements, time intervals, depth intervals, or the like. A person having ordinary skill in the art may appreciate that the invention may be applied to any portion of the drill string 20, the BHA 21, or the drill bit 12. Additionally, the invention may use one or more sensors to analyze movement of one or more portions of the drill string 20, the BHA 21 or the drill bit 12. The data may be analyzed in any manner as will be appreciated by those having ordinary skill in the art.

It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the claims.

We claim:

1. A method for determining movement of a drill bit in a wellbore to identify and correct drilling hazards, the method comprising:

(a) selecting a plurality of depth intervals within the wellbore to generate a data matrix wherein time is added to the matrix for each depth interval as the drill bit, bottom hole assembly, sensor or other component of a drill string passes the depth interval;

(b) generating depth measurements for a drill bit over a time period;

(c) determining a transit value for each depth interval over the time period based on the depth measurements of the drill bit wherein each of the transit values indicates a number of movements of the drill bit through a corresponding one of the depth intervals;

wherein the transit value further comprises at least one of a number of lateral shocks experienced through each of the depth intervals, delta pressure applied to the wellbore through each of the depth intervals, a number of pump cycles and total side forces applied to a wall of the wellbore through each of the depth intervals;

(d) transforming sensor data from a time index to a depth index;

(e) pairing the data matrix with sensor data;

(f) identifying one or more drilling hazards based on the transit values whereby corrective action is taken wherein the correction action comprises at least one of the following steps: (1) replacing the drill bit, a component of the bottom hole assembly, a portion or all of the bottom hole assembly, or a portion or all of the drill string, or (2) positioning a wireline and logging device or wellbore telemetry device into the wellbore; and (g) continuing steps a through f until drilling is complete.

2. The method of claim 1 wherein the time period is a total amount of time lapsed since initiation of drilling.

3. The method of claim 1 wherein the time period is based on a predetermined start time and a predetermined end time.

4. The method of claim 1 further comprising:

establishing a predetermined condition wherein the depth measurements associated with the drill bit moving during the predetermined condition are not used to determine the transit values.

5. The method of claim 1 further comprising:

establishing a predetermined distance wherein the depth measurements associated with the drill bit moving a distance less than the predetermined distance are not used to determine the transit values.

6. The method of claim 1 further comprising:

measuring data using tools adjacent to the drill bit wherein the data is associated with the transit values.

7. The method of claim 1 further comprising:

generating a graph having a first plot of the depth measurements as a function of time and a second plot of the transit values as a function of the time.

8. The method of claim 1, wherein the depth interval is in a range from about 0.1 to about 0.5 feet.

9. The method of claim 1, wherein each of the transit values further comprises a number of revolutions through which the drill bit has rotated in the corresponding intervals, the number of revolutions computed from the rate of rotation of the drill bit and the rate of penetration of the drill bit during drilling and reaming operations.

10. A method for determining movement of a drill bit in a wellbore to identify and correct drilling damage, the method comprising:

(a) selecting a plurality of depth intervals in the wellbore to generate a data matrix wherein time is added to the matrix for each depth interval as the drill bit, bottom hole assembly, sensor or other component of a drill string passes the depth interval;

(b) generating depth measurements for a drill bit over a time period;

(c) determining a transit value for each depth interval over the time period based on the generated depth measurements, the transit values indicating a number of times the drill bit moved through each of the depth intervals and a number of revolutions of the drill bit through each of the depth intervals wherein the transit value further comprises at least one of a number of lateral shocks experienced through each of the depth intervals, delta pressure applied to the wellbore through each of the depth intervals, a number of pump cycles and total side forces applied to a wall of the wellbore through each of the depth intervals;

(d) transforming sensor data from a time index to a depth index;

(e) pairing the data matrix with sensor data;

(f) correlating wellbore mechanical damage with the transit values whereby the damage is corrected; and (g) continuing steps a through f until drilling is complete.

11. The method of claim 10 further comprising:

transmitting the measurements to a terminal using wired drill pipe which has wired drill pipe segments that form at least a portion of the drill string wherein the terminal determines and visually indicates the wellbore stability for each of the plurality of depths.

12. The method of claim 10 further comprising:

generating the measurements at a plurality of times.

13. A method for determining movement of a drill bit in a wellbore to identify and correct drilling hazards, the method comprising:

(a) selecting a plurality of depth intervals in the wellbore to generate a data matrix wherein time is added to the matrix for each depth interval as the drill bit, bottom hole assembly, sensor or other component of a drill string passes the depth interval;

(b) generating depth measurements for a drill bit over a time period, wherein the depth measurements cumulatively comprise a BIT transit counter, cumulative revolutions, cumulative pressure cycles, cumulative pump cycles, cumulative shock cycles and cumulative side force events;

(c) reviewing the depth measurements to eliminate small changes in the drill bit travel direction;

(d) analyzing the depth measurements to determine a transit value for each depth increment over the time period based on the depth measurements of the drill bit wherein each of the transit values indicates a number of movements of the drill bit through a corresponding one of the depth increments;

(d) transforming sensor data from a time index to a depth index;

(e) pairing the data matrix with sensor data;

(f) identifying one or more drilling hazards whereby signals transmitted from a terminal correct the hazard; and (g) continuing steps a through f until drilling is complete.

14. The method of claim 13, wherein reviewing the depth measurements comprises establishing a predetermined distance wherein the depth measurements associated with the drill bit moving a distance less than the predetermined distance are not used to determine the transit values.

15. The method of claim 13, wherein each of the transit values further comprises a number of revolutions through which the drill bit has rotated in the corresponding intervals, the number of revolutions computed from the rate of rotation of the drill bit and the rate of penetration of the drill bit during drilling and reaming operations.

16. The method of claim 13, further comprising correlating wellbore mechanical damage with the transit values.

* * * * *